US007775170B2

(12) United States Patent
Zafiroglu

(10) Patent No.: US 7,775,170 B2
(45) Date of Patent: Aug. 17, 2010

(54) STITCHBONDED FABRIC WITH A DISCONTINUOUS SUBSTRATE

(75) Inventor: Dimitri P. Zafiroglu, Centreville, DE (US)

(73) Assignee: Xymid L.L.C., Midlothian, VA (US)

( * ) Notice: Subject to any disclaimer, the term of this patent is extended or adjusted under 35 U.S.C. 154(b) by 243 days.

(21) Appl. No.: 11/931,035

(22) Filed: Oct. 31, 2007

(65) Prior Publication Data

US 2008/0166516 A1 Jul. 10, 2008

Related U.S. Application Data

(60) Provisional application No. 60/883,838, filed on Jan. 8, 2007.

(51) Int. Cl.
*D05B 3/00* (2006.01)
*D05B 23/00* (2006.01)

(52) U.S. Cl. ..... 112/475.08; 112/402

(58) Field of Classification Search ..... 112/475.01, 112/475.06, 475.08, 475.17, 402, 406, 415, 112/429, 432, 433, 435; 2/275; 442/181; 428/102–104
See application file for complete search history.

(56) References Cited

U.S. PATENT DOCUMENTS 1,201,446 A * 10/1916 De Voe ..... 112/434
1,855,003 A * 4/1932 Snarck ..... 428/104
2,592,463 A * 4/1952 Phillips ..... 2/275
2,633,440 A * 3/1953 Scholl ..... 428/40.1
3,025,196 A 3/1962 Burger
3,567,565 A * 3/1971 Jones et al. ..... 428/102
4,269,883 A * 5/1981 Hasegawa ..... 428/120
4,704,321 A 11/1987 Zafiroglu
4,773,238 A 9/1988 Zafiroglu
4,818,579 A * 4/1989 Uchida ..... 428/102
4,876,128 A 10/1989 Zafiroglu
4,891,957 A 1/1990 Strack et al.
4,998,421 A 3/1991 Zafiroglu
5,041,255 A 8/1991 Zafiroglu
5,187,952 A 2/1993 Zafiroglu
5,192,600 A 3/1993 Pontrelli et al.
5,203,186 A 4/1993 Zafiroglu
5,247,893 A 9/1993 Zafiroglu
5,288,536 A 2/1994 Zafiroglu
5,308,674 A 5/1994 Zafiroglu
5,634,997 A 6/1997 Anzilotti et al.

(Continued)

OTHER PUBLICATIONS

Deneris, Kathleen, "Layer, Stitch, and Cut for a Terrific New Fabric With a Soft Lively Texture" Threads, Oct./Nov. 1996, pp. 31-33.

*Primary Examiner*—Ismael Izaguirre
(74) *Attorney, Agent, or Firm*—Jeffrey C. Lew

(57) ABSTRACT

A process makes stitchbonded fabric having a regionally segmented discontinuous base layer of webs of substrate material extending in the machine direction which webs are laterally separated by a region devoid of substrate material. The region devoid of substrate is formed prior to stitching by either (a) slitting the substrate and folding the material adjacent the slits outwardly in contact with substrate material outboard of the slit, or (b) slitting the substrate while applying tension in the machine direction that moves adjacent lips of the slit material away from each other. Once the discontinuous base layer is formed, threads are stitched through the laterally separated webs of substrate material and the intermediate region devoid of substrate material.

4 Claims, 4 Drawing Sheets

U.S. PATENT DOCUMENTS

| | | | | |
|---|---|---|---|---|
| 5,879,779 | A | 3/1999 | Zafiroglu | |
| 6,124,001 | A | 9/2000 | Sugita et al. | |
| 6,263,814 | B1 | 7/2001 | O'Conner | |
| 6,280,815 | B1 | 8/2001 | Ersfeld et al. | |
| 6,407,018 | B1 | 6/2002 | Zafiroglu | |
| 6,423,393 | B1 | 7/2002 | Wildeman | |
| 6,811,870 | B2 | 11/2004 | Zafiroglu | |
| 6,821,601 | B2 | 11/2004 | Tsiarkezos et al. | |
| 6,919,117 | B1 | 7/2005 | Kane et al. | |
| 6,936,327 | B2 | 8/2005 | Zafiroglu | |
| 6,991,690 | B2 * | 1/2006 | Strength et al. | 156/61 |
| 7,141,290 | B2 | 11/2006 | Tsiarkezos et al. | |
| 2003/0005599 | A1 | 1/2003 | Panaccione | |
| 2003/0220038 | A1 | 11/2003 | Tsiarkezos | |
| 2005/0196579 | A1 | 9/2005 | Zafiroglu | |
| 2008/0166520 | A1 * | 7/2008 | Zafiroglu et al. | 428/136 |
| 2008/0166532 | A1 * | 7/2008 | Tsiarkezos | 428/213 |

* cited by examiner

STITCHBONDED FABRIC WITH A DISCONTINUOUS SUBSTRATE

This application claims benefit of U.S. Provisional application No. 60/883,838 filed Jan. 8, 2007.

FIELD OF THE INVENTION

This invention relates to a fabric having a substrate layer stitchbonded with multi-needle stitched threads in which the substrate layer has some regions occupied by substrate material and other regions devoid of all substrate material. In a specific embodiment the fabric provides a remarkably high cross directional stretch and is useful in stretchable skirts for mattress covers, among other uses.

BACKGROUND OF THE INVENTION

Stitchbonded fabrics and methods for producing them are known, as for example from K. W. Bahlo, "New Fabrics without Weaving" Papers of the American Association for Textile Technology, Inc. pp. 51-54 (November 1965). Such fabrics are made by multi-needle stitching of various fibrous substrates with elastic or non-elastic yarns, as disclosed, for example, by the Zafiroglu in U.S. Pat. Nos. 4,704,321, 4,737,394 and 4,773,328.

Stitchbonded fabrics are versatile and have a wide variety of applications. Some fabric products, for example, covers for furniture, in particular mattress covers, call for the fabric to have good stretch and/or elastic stretch characteristics. Stitchbonded fabrics could be useful in such applications, however, many traditional stitchbonded fabrics have inadequate stretch capability. Customary stitchbonded fabrics typically have a plain and monotonously uniform appearance that can detract from a product's aesthetic appeal.

To improve stitchbonded fabric stretch, the incorporation of elastic stitching yarns has been used. Despite stitching with elastic yarns and gathering the stitched fabric in both machine direction ("MD") and cross direction ("XD") the amount of stretch of the gathered fabric has been limited. The limitations may result from the limited ability of the stitching yarns to stretch, constraint of the stitching pattern or, in respect to nonwoven substrates particularly, from the degrees of alignment and bonding of the substrate fibers. Stitching pattern limits stretch because the characteristic yarn angle of a stitchbonded fabric stitching pattern affects elongation. Yarn angle can depend upon the stitching thread counts per inch, the pattern notation, and spaces between adjacent stitches in the yarn notation. As concerns nonwoven substrate structures, parallel alignment of the fibers to high degrees (in the MD) tends to limit MD elongation and to promote fabric failure at low cross direction elongation when the nonwoven fibers are bonded to a relatively high degree. If the nonwoven fibers are aligned parallel to a lesser degree some additional XD stretch occurs but extension is limited by the interfiber bonding.

Selected advances in technology of stitchbonded fabrics are documented in many patents including those of D. Zafiroglu which are presently assigned to Xymid, L.L.C., such as U.S. Pat. No. 4,773,238; U.S. Pat. No. 4,876,128; U.S. Pat. No. 4,998,421; U.S. Pat. No. 5,041,255; U.S. Pat. No. 5,187,952; U.S. Pat. No. 5,247,893; U.S. Pat. No. 5,203,186; U.S. Pat. No. 5,308,674; U.S. Pat. No. 5,879,779; U.S. Pat. No. 6,407,018; U.S. Pat. No. 6,821,601; and U.S. Pat. No. 6,908,664.

A noteworthy utility for stitchbonded fabrics having desirable XD elongation and especially elastic XD elongation is that of skirts for mattress covers. A mattress cover skirt is a band of typically stretchable fabric attached to the periphery of and suspended downward from a top panel that covers the surface of the mattress. Usually the skirt is configured such that its MD is aligned with the periphery of the panel and XD corresponds to the normally narrower width of the skirt. The skirt may have some decorative function but mainly it stretches elastically to effectively hold the cover in place on the mattress. It is desirable to have mattress cover skirts with good cross direction as well as machine direction stretch properties.

Many inventions pertaining to cover skirt technology are disclosed in various patents now assigned to Xymid, L.L.C., such as U.S. Pat. No. 5,636,393; U.S. Pat. No. 5,603,132; U.S. Pat. No. 6,199,231; U.S. Pat. No. 6,272,701; U.S. Pat. No. 6,842,921; and U.S. Pat. No. 6,883,193. The entire disclosures of all U.S. patent and patent applications identified herein are hereby incorporated by reference herein.

A very interesting new type of stitchbonded fabric with remarkably good XD stretch properties uses a discontinuous substrate such that some regions of the fabric have stitches through substrate material and other regions have stitches but no substrate material. The fabric has high XD extension because the stitch-only regions can stretch without the constraint of the substrate. Stretch in these substrate-free regions depends on the characteristics of the stitches such as the stitching pattern and stitching thread extension properties.

Some methods are now being evaluated for producing stitchbonded fabrics with discontinuous substrate layers with conventional stitchbonding machines. Those methods call for using separate pieces of substrate fed to the machine inlet. The pieces are typically supplied on rolls spaced laterally apart in the XD direction so that gaps exist between adjacent pieces as the rolls unwind into the stitchbonder. The machine stitches across the full width of the feed stock thereby placing stitches in substrate material and in open spaces of the gaps between the substrate material. This is an effective but awkward operating style because the substrate pieces must be produced and handled separately. The XD widths of the separate pieces have to be managed correctly so that the small width pieces and the desired gaps fill the full width of the stitchbonding machine to obtain optimum productivity. Considerable logical planning should be used to set up each production run. Additionally a separate cutting step to provide the narrow width pieces of substrate material from wider stock widths almost inevitably creates waste. Some width of the stock material does not fit into the configuration of separate pieces of the stitchbonded fabric and must be discarded. Moreover the cutting step adds time and energy to the overall process.

Another method being considered for making discontinuous substrate stitchbonded fabrics calls for feeding a continuous integrated substrate material. Before the substrate enters the stitching section, strips of the substrate are excised in situ from the substrate layer. While this technique simplifies the logistical planning for making discontinuous substrate stitchbonded fabrics, it does not solve the waste creation problem. The material cut away as strips have little use if any and are likely to be discarded.

It is desirable to have a stitchbonded fabric that provides high stretch and and optionally elastic stretch especially in the cross direction provided by discontinuous substrate structure. A method of making such a discontinuous substrate stitchbonded fabric having superior stretch that is simple to manufacture with only minor modifications of conventional stitchbonding equipment is also much desired.

SUMMARY OF THE INVENTION

Accordingly, the present invention broadly provides a novel stitchbonded fabric by stitching a base layer. The substrate material that forms the base layer preferably is a nonwoven fibrous structure. A pattern of stitching, preferably a uniform stitching pattern, is present over the full extent of the base layer. Just prior to stitching, the substrate material is slit. In one aspect, the lips of the slit are folded laterally outward onto adjacent substrate and then stitched. In another aspect, the slit substrate is subjected to tension in the MD such that the substrate material contracts in the XD. The tensioned substrate material laterally separates downstream from each slit creating a region completely devoid of substrate material and the stitching thus provides stitched-over areas where the stitches penetrate substrate material and stitched open areas where the stitches are made in the substrate-free regions.

The present invention therefore provides a stitchbonded fabric defining a machine direction and a cross direction perpendicular thereto, the fabric being formed by the process comprising the steps of (A) providing a substrate material having two outboard edges along the machine direction, and providing a continuously operable multi-needle stitching machine, (B) feeding the substrate material to an entrance of the stitching machine, (C) slitting the substrate material at one or more positions intermediate the outboard edges, thereby producing a slit in the substrate material at each of said positions defining opposing lips, the slit extending in the machine direction, (D) folding at least one lip outward in contact with the substrate material adjacent the slit thereby forming a discontinuous base layer comprising a multilayer region of the substrate material extending in the machine direction and an open space region of the base layer extending in the machine direction and adjacent to the multilayer region which open space region is devoid of substrate material, and (E) multi-needle stitching threads throughout the extent of the discontinuous base layer with at least one pattern of stitches in rows running in a machine direction and spaced apart in a cross direction, thereby forming an integrated fabric of stitched-over substrate areas of the base layer.

Also this invention provides a process for making a stitchbonded fabric comprising the steps of (A) providing a substrate material having two outboard edges along the machine direction, and providing a continuously operable multi-needle stitching machine, (B) feeding the substrate material to an entrance of the stitching machine, (C) slitting the substrate material at one or more positions intermediate the outboard edges, thereby producing a slit in the substrate material at each of said positions defining opposing lips, the slit extending in the machine direction, (D) folding at least one lip outward in contact with the substrate material adjacent the slit thereby forming a discontinuous base layer comprising a multilayer region of the substrate material extending in the machine direction and an open space region of the base layer extending in the machine direction and adjacent to the multilayer region which open space region is devoid of substrate material, and (E) multi-needle stitching threads throughout the extent of the discontinuous base layer with at least one pattern of stitches in rows running in a machine direction and spaced apart in a cross direction, thereby forming an integrated fabric of stitched-over substrate areas of the base layer.

Additionally there is provided a stitchbonded fabric defining a machine direction and a cross direction perpendicular thereto, the fabric being formed by the process comprising the steps of (A) providing a web of substrate material and having two outboard edges along the machine direction, and providing a continuously operable multi-needle stitching machine, (B) feeding the web to an entrance of the stitching machine, (C) slitting the web at one or more positions intermediate the outboard edges, thereby producing a slit in the web at each of said positions defining opposing lips, the slit extending in the machine direction, (D) applying a tension force to the web in the machine direction effective to cause the lips of each slit to separate from each other in the cross machine direction thereby forming a discontinuous base layer comprising two regions of the web extending in the machine direction and an open space region of the base layer devoid of substrate material extending in the machine direction between the two regions of the web, and (E) multi-needle stitching threads throughout the extent of the discontinuous base layer with at least one pattern of stitches in rows running in a machine direction and spaced apart in a cross direction, thereby forming an integrated fabric of stitched-over substrate areas of the base layer.

Moreover this invention yet further provides a process for making a stitchbonded fabric comprising the steps of (A) providing a web of substrate material and having two outboard edges along the machine direction, and providing a continuously operable multi-needle stitching machine, (B) feeding the web to an entrance of the stitching machine, (C) slitting the web at one or more positions intermediate the outboard edges, thereby producing a slit in the web at each of said positions defining opposing lips, the slit extending in the machine direction, (D) applying a tension force to the web in the machine direction effective to cause the lips of each slit to separate from each other in the cross machine direction thereby forming a discontinuous base layer comprising two regions of the web extending in the machine direction and an open space region of the base layer devoid of substrate material extending in the machine direction between the two regions of the web, and (E) multi-needle stitching threads throughout the extent of the discontinuous base layer with at least one pattern of stitches in rows running in a machine direction and spaced apart in a cross direction, thereby forming an integrated fabric of stitched-over substrate areas of the base layer.

DETAILED DESCRIPTION OF THE INVENTION

Figure 1:
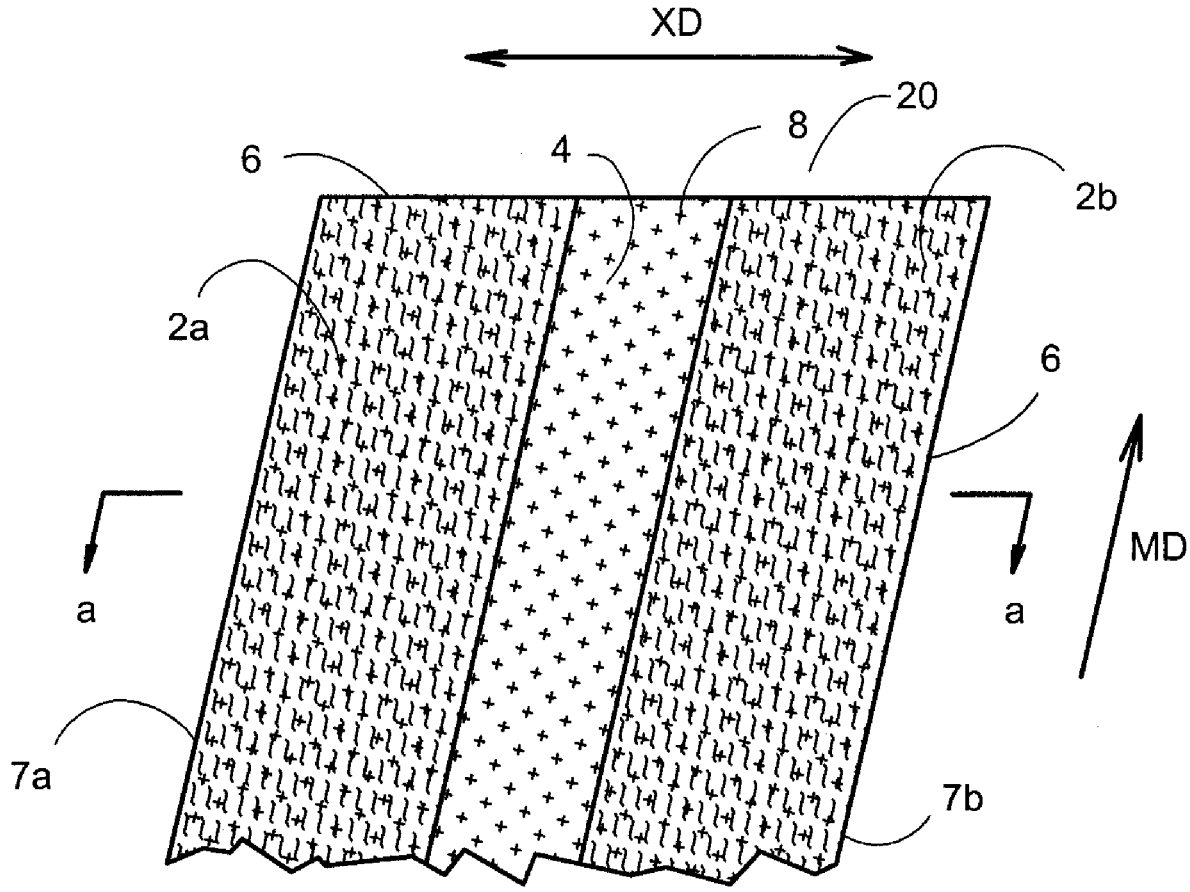
FIG. 1 is a perspective view of a stitchbonded fabric which has been formed by stitching through a discontinuous base layer according to this invention.

Traditionally, the term "stitchbonded" refers to the result of a multi-needle stitching operation performed on a base layer of a web of substrate material.

The meaning of the term "fiber" includes staple fiber (i.e., finite length filament) and continuous filament. The term "textile decitex" means fibers in the range of 1 to about 22 dtex. The fibers may be naturally occurring fibers or fibers made of synthetic organic polymers.

To prepare stitchbonded fabrics in accordance with the present invention, conventional multi-needle stitching equipment, having one or more needle bars, can be employed. In the stitching step, spaced apart, preferably parallel rows of stitches are formed in the base layer, the rows extending along the length of the fabric which usually corresponds to the so-called "machine direction" or "MD", i.e., direction of travel of the fabric through the stitching machinery. The width of the fabric usually corresponds to the direction across the machine and perpendicular to the MD, which is referred to herein as the cross direction or "XD". The stitching pattern or patterns are on the whole area of the base layer. The stitching pattern is preferably uniform in the XD such that the thread patterns are uniformly stitched throughout the fabric.

Many types of substrate material such as textile or cellulosic fibrous web, (i.e. cloth or paper) and non-fibrous webs such as polymeric film or metal foil, are suitable for use in the base layer of this invention. In preferred embodiments the substrate material is a fibrous web and can be a nonwoven, woven, knit, or composite fabric of nonbonded fibers. Representative of suitable substrate materials are batts of carded fibers, air-laid fiber batts, nonwoven sheets of continuous filaments, lightly consolidated or lightly bonded spunbonded sheets, sheets of hydraulically entangled fibers, and the like. The base layer substrate material can be a monolithic fibrous structure, that is having only a single stratum composition. It is also contemplated that the substrate material can comprise a plurality of strata having different compositions, thicknesses, densities and similar characteristics. Each stratum can be selected to contribute desired physical properties such that the assembly of strata cumulatively provides quality such as thickness, weight, permeability, dyeability and the like, uniquely tailored to the end use application.

Substantially any strong thread or yarn is suitable for the stitching. The terms "thread" and "yarn" are used herein interchangeably to mean a single continuous strand of one or more plies of fiber. The stitching thread can be stretchable or non-stretchable. The terms "stretch", "stretchable" and "stretching" herein refer to the incremental elongation to which a fiber, filament, yarn or fabric can extend under specified tension without incurring substantial structural damage. In present context, a fiber, filament, yarn or fabric is considered non-stretching if its incremental elongation is less than about 3% of the object's corresponding pre-tensioned dimension. The stitching thread, if stretchable, optionally also can be elastic. The terms "elastic", "elasticity", "elastically" herein refer to the property of a fiber, filament, yarn or fabric to stretch when under tension and then, when the tension is released, to recover rapidly to nearly its original length.

Conventional elastic yarns, such as bare or covered yarns of spandex or rubber, and textured stretch yarns of nylon or polyester or other synthetic polymers, are well suited for use in the fabrics of the invention. A preferred stitching thread is a spandex elastomeric yarn that has high elongation (e.g., 300-800%) and high retractive power. As used herein, the term "spandex" has its conventional meaning, that is, a manufactured fiber in which the fiber-forming substance is a long chain synthetic polymer comprised of at least 85% of a segmented polyurethane. Such preferred yarns are available commercially (e.g., "Lycra" spandex yarn sold by Invista North America S.A.R.L., Wilmington, Del.).

The stitching thread can also comprise elastic combination yarn. The term "elastic combination yarn" refers to a yarn having a first component of elastic fiber combined with a second component of non-elastic (i.e., occasionally called "hard") fiber. The elastic-filament content of the combination yarn can be within a wide range. The elastic-filament content can amount to as much as 60% percent of the total weight of the combination yarn. More typically, the elastic fiber content is in the range of 2 to 20% of the total weight of the yarn and a content of 3 to 8% generally is preferred for reasons of cost. Usually, the combination yarn is a bulky yarn that is capable of a considerable elastic stretch and recovery. Typical elastic combination yarns for use in the present invention have a recoverable elongation in the range of 50% to 250%, or even higher. Preferably spandex fiber is the elastic component of elastic combination yarns for use in this invention. Known techniques can be used to combined the component fibers such as air-jet entangling, air-jet intermingling, covering, plying and the like.

The stitch density range acceptable for the invention is within the knowledge of one of ordinary skill in the art in view of the present disclosure. Typically, the number of rows of stitches across the width of the fabric (i.e., in the cross direction) that are inserted into the base layer by the multi-needle stitchbonding machine is in the range of about 1 to 10 per centimeter. Common conventional needle bars, for example, 6-gauge, 12-gauge, 14-gauge and 28-gauge are suitable. The number of stitches along the length of each row is usually also in the range of 1 to 10 stitches per cm.

The stitch-bonding can be performed with conventional multi-needle stitching equipment, such as "Arachne", "Liba" or "Mali" (including Malimo, Malipol and Maliwatt machines). Such machines and some fabrics produced therewith are disclosed by K. W. Bahlo, "New Fabrics Without Weaving", Paper of the American Association for Textile Technology, Inc., pages 51-54 (November, 1965), by Ploch et al, U.S. Pat. No. 3,769,815, by Hughes, U.S. Pat. No. 3,649,428 and in Product Licensing Inex, Research Disclosure, "Stitchbonded products of continuous filament nonwoven webs", page 30 (June 1968).

During fabrication of the stitchbonded product, stitchbonding threads will be inserted according to a pre-selected stitching pattern in conventional manner across the full width of the base layer. Therefore stitchbonding will bridge across the slits and consequently the stitching threads will seamlessly bind the substrate material into an integrated fabric. Preferably there is no need to fix the edges of the slit substrate for example with an adhesive and/or a mechanical (e.g., sewn) selvage. Thus the novel method avoids creating a bulky and aesthetically undesirable structure at the lips of the slits.

The variable stretch or variable density of the fabric is achieved by utilizing a discontinuous base layer. By "discontinuous base layer" is meant that the substrate material is completely absent from at least one region of the base layer and does exist at other regions. Regions of the base layer where the substrate material is present are "substrate regions". Regions of the base layer devoid of substrate material are "non-substrate regions". Typically the non-substrate region of the base layer is created by feeding disjointed pieces of substrate material separated by gaps into a stitchbonding operation. Techniques for this will be further explained in the discussion, below.

Stitching by the stitchbonding yarns occurs over the extent of the discontinuous base layer such that the stitching is through the substrate regions and the non-substrate regions. Therefore, the stitching yarns stitch through the substrate material in the substrate region and stitch through open space in the non-substrate region. The area or areas of the stitchbonded fabric occupied by the substrate region comprises substrate material and stitches of stitching yarns that penetrate the substrate material. Such area is occasionally referred to as the "stitched-over substrate" part. The area of the stitchbonded fabric comprising stitching yarns stitched through the non-substrate regions of the base layer and free of substrate is referred to as the "stitched open" part. Only stitchbonding yarns are present in the stitched open part.

It can be seen that by strategic placement of one or more substrate regions and one or more non-substrate regions together, and with optional use of suitable stretchable or elastic stitching yarns, a stitchbonded fabric that exhibits remarkably higher cross direction stretch or elastic stretch can be obtained than would result from a conventional stitchbonded fabric of same substrate and comparable stitchbonding density. Because the stitched open regions are constituted only by stitches of stitching yarns, they are not constrained against cross direction extension by substrate material. Therefore, even with non-stretchable and non-elastic stitching yarns, these regions can stretch to greater extent, especially in the cross direction, than stitched-over substrate regions. The stretch is generated by play between the yarns from slackness intrinsic to the stitch geometry and the stitching pattern utilized. That is, the stitched open fabric regions can expand and contract much like a knit fabric reversibly expands under tension due to the loop structure of the knit. Accordingly, a stitching pattern with few stitches per unit length will provide a higher stretch than a more closed pattern with a larger number of stitches per unit length.

Elastic stretch of the stretchable fabric can be achieved by utilizing elastic stitching yarns. Stretch of the stitched over substrate portion is limited by presence of the substrate material. As mentioned, the stitched open regions are not so constrained. Accordingly, overall stretch of non-substrate regions stitched with elastic yarns can be improved to extraordinarily high values.

In one aspect, this invention pertains to a fabric having the heretofore described features. FIG. 1. shows an embodiment of a section of the novel stitchbonded fabric 20 formed of a discontinuous substrate base layer comprising two strips 7*a* and 7*b* of a substrate web material 6. The strips are spaced apart in the cross direction XD. The combination of strips and open space constitute a discontinuous base layer in which the strips 7*a*,7*b* are substrate regions and the intermediate space is the non-substrate region of this embodiment. Fabric 20 is produced by feeding the substrate in the machine direction MD into a stitchbonding machine. During the stitchbonding step, yarns 8 are stitched across the extent of the base layer in the XD. The resulting product consists of stitching yarns 8 stitched through stitched-over substrate region 2*a* of stitched web strip 7*a*, stitched open region 4, and stitched-over substrate region 2*b* of stitched web strip 7*b*. From FIG. 1 it is seen that all cross direction sections of the web a-a intersect with at least one non-substrate area. Hence enhanced cross direction stretch results when the regions are positioned such that a section of the base layer taken in the cross direction passes through a non-substrate region.

The fraction of the XD width that extends through stitch open area is expected to be within the range of about 0.5% to 90%, and preferably 1 to 20%. A complementary fraction should extend through stitched-over substrate area. If the width of the stitch open area is too small, cross direction stretch will not be much increased over that of traditional stitchbonded fabric. If the stitch open area width is too large, the fabric will lose benefit of the properties of the substrate material.

An easily implemented and highly effective method of creating stitchbonded fabrics with a discontinuous base layer has been developed. The preferred method includes continuously feeding a unitary, integrated web of substrate material to a stitchbonding machine. As the web is being fed it is maintained in a state of underfeed tension in the MD. That is, an MD tensile force is applied to the web. Any conventional technique for producing the tension can be used. Typically the underfeed tension is induced by unwinding the web from its supply roll at a linear feed rate that is slightly less than the take-up rate of the stitchbonded product on the discharge side of the stitchbonding machine. While in this state of tension and before the stitchbonding threads are stitched through the substrate, the web of substrate is ruptured. The tension in the MD causes web contraction the XD at the rupture site. More specifically, the web on either side of the rupture site contracts in the XD away from the point of rupture. Thus the rupture under tension causes the substrate to automatically and instantaneously create a gap moving downstream from the rupture site toward the needle bars of the stitchbonding machine. The gap-containing substrate continues into the stitchbonding machine in which stitching of the stitchbonding threads across the expanse of the now discontinuous base layer occurs such that stitching yarns penetrate substrate material on both sides of the created gap and seamlessly across the open space of the gap itself.

Figure 2:
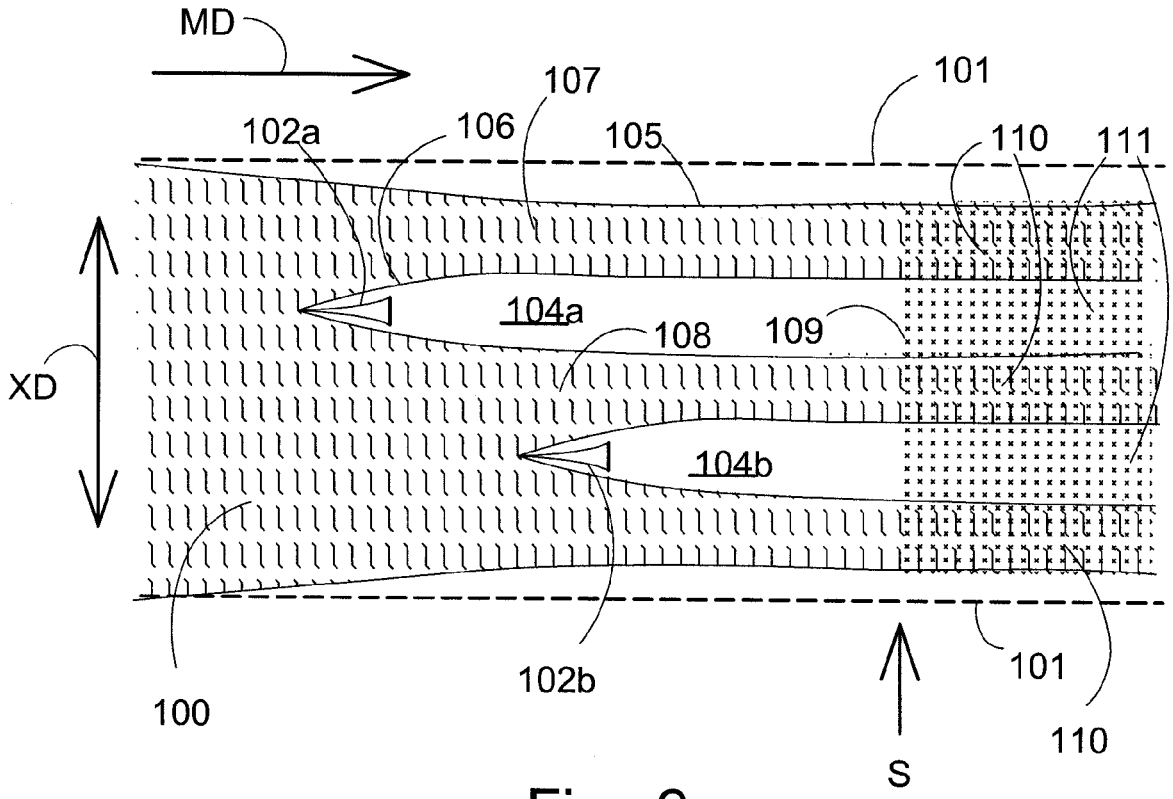
FIG. 2 is plan schematic view of the novel stitchbonded fabric being fabricated according to a preferred method in which the web is fed to a stitchbonding machine in a state of underfeed tension and ruptured prior to stitchbonding.

This embodiment of the novel method can be better understood with reference to FIG. 2. The figure shows a plan view of a unitary and integrated web 100 of substrate material being fed in the MD direction. By "unitary and integrated" is meant that the web is a single entity capable of being fed to the stitchbonding machine as a unit. The unitary and integrated web can be uniformly intact as shown at 100. Optionally, the unitary and integrated web can contain voids such as open space(s) between yarns and pre-formed perforations. Also, several independent strips of individually unitary and integrated substrate webs positioned alongside each other in the XD can be fed simultaneously to a single stitchbonding machine although the figure illustrates only a single unitary and integrated web 100.

The web is in a state of underfeed tension that causes the web to contract in the XD direction. XD direction contraction is sometimes referred to as "necking in". This phenomenon is shown in the figure by web outer border 105 that moves laterally toward the central axis of the moving web. The inwardly deflecting border 105 thus deviates from the straight path that the outer edge of the substrate would otherwise have taken had the web been fed under no or negligible tension. The untensioned outer border path is indicated by dashed line 101 to show the necking in of the substrate material.

A rupturing instrument 102*a* such as a stationary knife blade is positioned to pierce the web 100. After rupturing, the web splits to two substrate regions 107 and 108 on opposite sides of the blade. Also these substrate regions "neck in". For example, the edge 106 of the ruptured web moves laterally away in the XD from the knife blade and the width of the substrate region 107 defined by the XD dimension between border 105 and edge 106 diminishes within a short distance downstream of the knife blade and then attains a steady state, uniform width. The necking in phenomenon produces a gap 104*a* between substrate regions 107 and 108. The figure makes evident that a single blade is able to create a discontinuous base layer with strips of substrate material set apart in the XD from each other by a gap of empty space.

This preferred method of parting the substrate material by slitting the material under tension and before stitching can be accomplished with those substrate materials that have the tendency to neck-in under tension applied perpendicularly to the neck-in direction. This parting effect can occur in fibrous substrate materials when the fiber or yarn network includes cross-directional or obliquely directed yarns or fibers that tend to align in the machine direction upon application of MD tension. This alignment causes a narrowing in the XD. Substrate materials of this type include for example nonwovens with multidirectional fiber orientations, especially entangled nonwovens such as spunlaced nonwovens or needle-punched nonwovens, and knit fabrics. Polymeric films can also exhibit this necking-in effect under tension. Thus slitting while applying MD tension to such substrate materials induces the edges of the slits to move away from each other as the substrate necks-in. The novel method relies on the slit edges to be parted such that the strips of substrate material on opposite sides of the slits arrive at the stitching station separate from each other by an open area.

The amount of necking in and accordingly the width of the open space between substrate regions depends upon numerous factors including the amount of underfeed tension and the stretching capacity of the substrate material just described. One of ordinary skill in the art given the knowledge of this disclosure should have no difficulty in adjusting operating conditions to produce a gap of desired dimensions without undue experimentation. Typically the necking in on one side of a rupturing instrument will be about 0.25 to about 3 inches, hence this procedure is usually able to produce open spaces in the substrate web of about 0.5 to about 6 inches wide. Following the rupture and separation of the substrate regions, the web continues to feed into the stitchbonding machine. Stitches 109 of stitchbonding threads are schematically indicated to begin at MD position "S". The novel stitchbonded fabric product with stitched over substrate areas 110 and stitched open areas 111 as described above is thus produced.

The figure also illustrates that optionally multiple rupturing instruments such as second knife blade 102*b* can be deployed to generate additional XD gaps (e.g., 104*b*). All the rupture points can be at the same MD position or they can be displaced in the MD from other each other as shown in FIG. 2. Other conventional cutting tools can be used as the rupturing instruments such as wires, flames, laser beams, rotary saws to name a few. In a particularly preferred embodiment, one or more blades can be mounted on a jig proximate to the throat of the stitchbonding machine and brought into contact with the unitary and integrated substrate web either continuously or intermittently. For example multiple blades can be affixed pointing outwardly from the surface of a cylindrical rotating drum in contact with the web such that the blades repeatedly approach, penetrate and recede from the web. Each penetration causes a discrete gap in the web having a leading tip, a length in the MD, and a following tip where the web reforms a unitary and integrated form as the blade recedes. This and other similar rupturing tool configurations can produce a wide variety of discontinuous base layer conformations and many interesting and useful stitchbonded fabric product variations.

Another advantageous feature of this invention is that increased cross direction stretch capability can be provided to a stitchbonded fabric with little change to existing fabrication equipment. Consequently, the cost to make the improved product is quite comparable to that of traditional stitchbonds. The difficulty of attaching cross direction stretchable panels, for example by sewing or gluing, to conventional stitchbond fabric panels is obviated by forming the stretchable panel in situ with the stitchbond.

Figure 3:
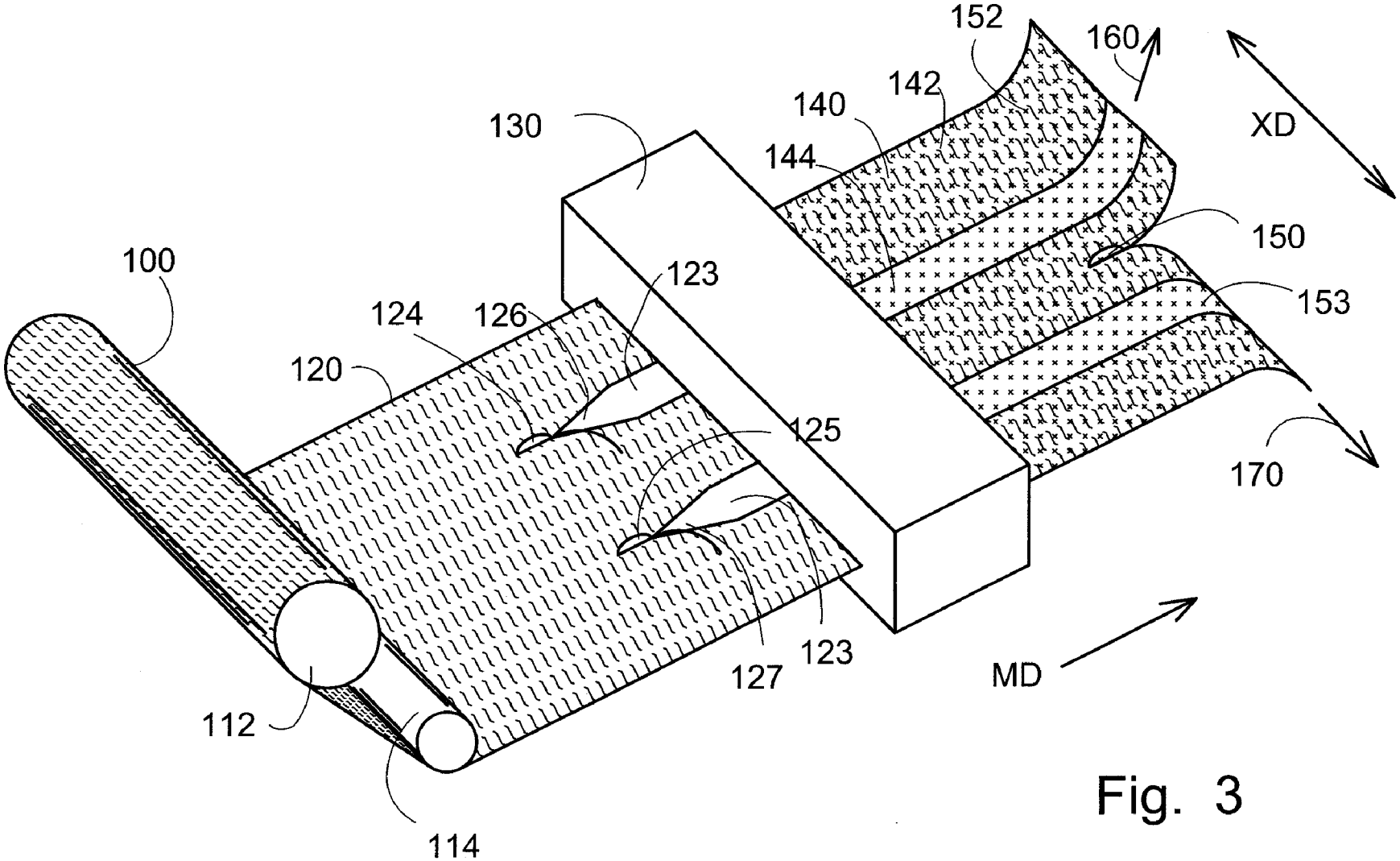
FIG. 3 is a perspective schematic view of an apparatus in the process of making a stitchbonded fabric according to the present invention.

Adaptability of the novel process of this invention to existing manufacturing equipment is by explained FIG. 3. A substrate material web 100 is supplied as a roll wound on core 112. The web is re-directed by roll subsystem 114 to feed continuously into a conventional stitchbonding machine 130. Upstream of the stitchbonder at 120 the web is a single piece construct extending across the width of the mouth of the machine in direction XD. Knives 124, and 125, cut the web in the machine direction to form slits 126 and 127, respectively. Web 120 is maintained under MD tension between the knives and the stitchbonding machine such that the substrate sections on opposite sides of the slits contract away from each other in the XD. The web thus forms parallel sections separated by voids 123 that were created by the contraction. In the machine the web is needled with multiple bars of stitching threads (not shown). The stitchbonded fabric continuously discharges from the stitchbonding machine in the MD as a unitary piece integrated by stitches 140. These stitches are coextensive with the stitched-over substrate area 142 and the stitch open area 144. The latter is the area of stitches corresponding to voids 123. The stitchbonded fabric can be removed from the stitchbonder conventionally as a single piece and wound onto rolls or cut directly into pre-selected shaped pieces. An optional configuration is shown in which the stitchbonded fabric encounters a slitter blade 150. There it is cut to separate segments 152 and 153 of desired pre-selected XD widths. The segments are withdrawn to storage or subsequent processing in direction of arrows 160 and 170, respectively, by conventional equipment, not shown. Each segment is seen to incorporate stitched-over substrate areas and stitch open areas. It has been found that when wide voids are created in the discontinuous base layer it can be helpful to provide downward pressure on the stitching threads particularly in the stitched open region to cast off the thread from the needles during stitching. Various methods for applying such pressure are well known in the art. For example, the bars can be held down or adjusted to shorter stitching stroke. The illustrated embodiment is meant to be a representative, non-limiting example of the novel product and process.

The preceding disclosure has emphasized the aspect of this invention in which a discontinuous base layer of substrate is stitchbonded such that the combination of stitched-over substrate and stitched open regions provides greater XD extension than provided by the same continuous substrate similarly stitchbonded without stitched open regions being present. The overall fabric hyperextension results largely from the phenomenon that application of cross direction tension causes the least constrained element, that is, the stitched open regions, to stretch without much stretching of the stitched-over substrate regions. This continues with much further applied tension until the stitched open regions reach a limit that depends upon stitch density, stitch pattern, stitching yarn composition and the like. Still further applied tension causes the stitched-over substrate regions to stretch, however these regions are constrained by the innate stretch resistance of the substrate. Further fabric extension under these conditions is similar to that which occurs in conventional stitchbonded fabric wherein the base layer is continuous and stitched open regions are absent. From the foregoing it is observed that the overall XD extension of the novel fabric is owed to a contribution from the high modulus (i.e., stress per unit strain) extension of the stitched open regions and the low modulus extension of the stitched-over substrate regions. It is contemplated that this ability to control extension can be very useful to provide highly engineered products such as medical devices.

Figure 4:
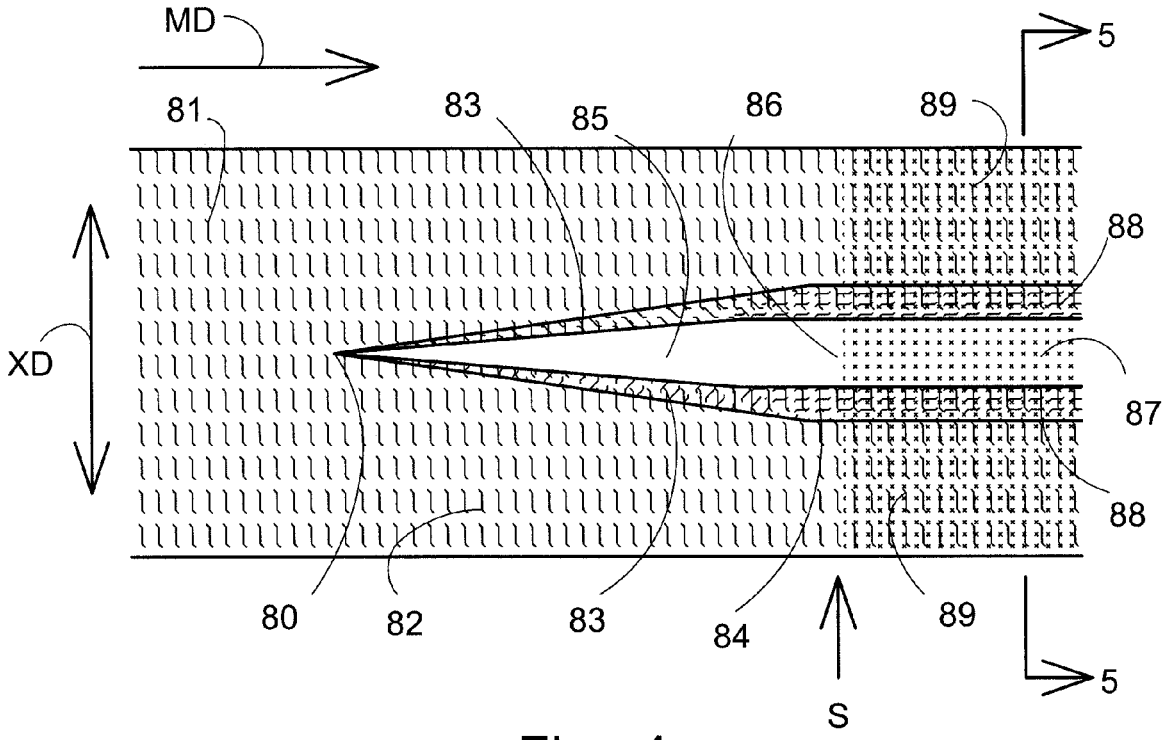
FIG. 4 is a plan schematic view of the novel stitchbonded fabric being fabricated according to a preferred method in which the web is fed to a stitchbonding machine, is ruptured to form a slit and lips of the slit are folded outwardly over the adjacent web prior to stitchbonding.
Figure 5:
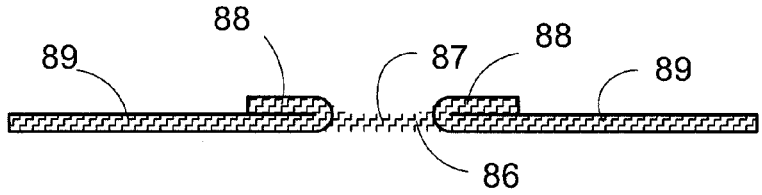
FIG. 5 is an elevation section view of the stitchbonded fabric of FIG. 4 taken through line 5-5.

In another embodiment the novel stitchbonded fabric comprises a discontinuous base layer and the substrate areas optionally have different densities. A method of making this fabric is understood with reference to FIG. 4. The structure of the novel fabric is illustrated schematically in FIG. 5 which is a section taken along line 5-5 of FIG. 4A base layer 81 of a fabric substrate 82 is seen to be continuous initially as fed in the MD and has substantially uniform density in the XD. The base layer is slit as it progresses in the MD at point 80 by a knife blade (not shown). The two lips 83 of the cut substrate fabric are forced upward and outward in the XD as the base layer advances in the MD. This shaping of the lips can be accomplished with a flared curvature tool positioned downstream of the blade, by forcing the lips upward against a low ceiling of the stitchbonding machine throat or other conventional techniques. The lips thus fold over onto the substrate to form a double layer thickness of substrate fabric 84 on each side of the slit. The area 85 between the two lips is thus devoid of substrate material and renders the base layer discontinuous as it moves forward. The arrow labeled S indicates the relative machine direction position at which the discontinuous substrate with lips folded over begins to travel under the stitchbonding bars. At this point a pattern of stitches 86 is stitched across the full width of the base layer in the XD. The stitchbonding results in an embodiment of the novel fabric having a central stitched open region 87 flanked on both sides by first stitched-over substrate regions 88 and farther outward second stitched-over substrate regions 89. As seen best in FIG. 5, stitched-over substrate region 88 comprises a double layer of the substrate material 82 folded onto itself and stitchbonded, while stitched-over substrate region 89 has a single layer of substrate material. Although FIGS. 4 and 5 show the fabric produced by a single slitting blade, it is contemplated that more than one blade in the XD can be utilized to form multiple corresponding stitched open regions as seen in FIG. 2.

Other techniques in the field of making stitchbonded fabrics can be used in combination with the basic aspect of this invention. For example, non-uniformly threaded stitching bar patterns may be used as well as uniformly threaded stitching bar patterns may be employed to stitch the discontinuous base layer. That is, more stitching threads may be used in some MD bands than in other MD bands. The conditions of width of substrate regions, presence or absence of stitched open areas, densities of different substrate regions and variability of stitching bar threading can all be utilized in combination to obtain a controlled amount of stretch or other physical property that is different from the stretch or physical property achieved conventionally by stitchbonding a uniform continuous substrate.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A process for making a stitchbonded fabric comprising the steps of (A) providing a substrate material having two outboard edges along the machine direction, and providing a continuously operable multi-needle stitching machine, (B) feeding the substrate material to an entrance of the stitching machine, (C) slitting the substrate material at one or more positions intermediate the outboard edges, thereby producing a slit in the substrate material at each of said positions defining opposing lips, the slit extending in the machine direction, (D) folding at least one lip outward in contact with the substrate material adjacent the slit thereby forming a discontinuous base layer comprising a multilayer region of the substrate material extending in the machine direction and an open space region of the base layer extending in the machine direction and adjacent to the multilayer region which open space region is devoid of substrate material, and (E) multi-needle stitching of threads throughout the extent of the discontinuous base layer by threads in the open space region and in the at least one lip of the substrate material with at least one pattern of stitches in rows running in a machine direction and spaced apart in a cross direction, thereby forming an integrated fabric of stitched-over substrate areas of the base layer.

2. The process of claim 1 in which the substrate material is selected from the group consisting of nonwoven, woven or knit fabrics of fibers of textile decitex, nets, foam sheets and polymeric film.

3. A process for making a stitchbonded fabric comprising the steps of (A) providing a web of substrate material and having two outboard edges along the machine direction, and providing a continuously operable multi-needle stitching machine, (B) feeding the web to an entrance of the stitching machine, (C) slitting the web at one or more positions intermediate the outboard edges, thereby producing a slit in the web at each of said positions defining opposing lips, the slit extending in the machine direction, (D) applying a tension force to the web in the machine direction effective to cause the lips of each slit to separate from each other in the cross machine direction thereby forming a discontinuous base layer comprising two regions of the web extending in the machine direction and an open space region of the base layer devoid of substrate material extending in the machine direction between the two regions of the web, and (E) multi-needle stitching of threads throughout the extent of the discontinuous base layer with at least one pattern of stitches in rows running in a machine direction and spaced apart in a cross direction, thereby forming an integrated fabric of stitched-over substrate areas of the base layer.

4. The process of claim 3 in which the substrate material is selected from the group consisting of nonwoven, woven and knit fabrics of fibers of textile decitex, foam sheets, nets and polymeric film.

* * * * *